US010436430B2

(12) United States Patent
Coleman

(10) Patent No.: US 10,436,430 B2
(45) Date of Patent: Oct. 8, 2019

(54) LIGHTING APPLIANCE WITH MULTIPLE DETECTION MODES

(71) Applicant: GOOD EARTH LIGHTING, INC., Mount Prospect, IL (US)

(72) Inventor: Brian Coleman, Hawthorn Woods, IL (US)

(73) Assignee: Good Earth Lighting, Inc., Mt. Prospect, IL (US)

( * ) Notice: Subject to any disclaimer, the term of this patent is extended or adjusted under 35 U.S.C. 154(b) by 0 days.

(21) Appl. No.: 15/984,813

(22) Filed: May 21, 2018

(65) Prior Publication Data

US 2019/0113215 A1 Apr. 18, 2019

Related U.S. Application Data

(60) Provisional application No. 62/573,992, filed on Oct. 18, 2017.

(51) Int. Cl.
*F21V 23/04* (2006.01)

(52) U.S. Cl.
CPC ..... *F21V 23/0471* (2013.01); *F21V 23/0442* (2013.01); *F21V 23/0485* (2013.01); *F21V 23/0492* (2013.01)

(58) Field of Classification Search
CPC ..... F21V 23/0442; F21V 23/0464; F21V 23/0471; F21V 23/0478; F21V 23/0485; F21V 23/0492; H05B 37/02; H05B 37/0218; H05B 37/0227; H05B 33/0842; H05B 33/0872
See application file for complete search history.

(56) References Cited

U.S. PATENT DOCUMENTS

| | | | | |
|---|---|---|---|---|
| 9,236,767 | B2 | 1/2016 | Recker et al. | |
| 2005/0231948 | A1 | 10/2005 | Polhert et al. | |
| 2011/0172839 | A1* | 7/2011 | Brown | B60L 3/0069 700/292 |
| 2013/0204408 | A1 | 8/2013 | Thiruvengada et al. | |
| 2015/0035440 | A1* | 2/2015 | Spero | B60Q 1/04 315/153 |

(Continued)

OTHER PUBLICATIONS

Notification of Transmittal of the International Search Report and the Written Opinion of the International Searching Authority, or the Declaration for PCT/US2018/056542, dated Jan. 3, 2019, 10 pages.

*Primary Examiner* — Van T Trieu
(74) *Attorney, Agent, or Firm* — McDermott Will & Emery LLP

(57) ABSTRACT

A lighting system includes a housing, a lighting element at least partially disposed in the housing, an electrical communication system in communication with the lighting element, and a sensor disposed on a portion of the housing, the sensor being in communication with the lighting element via the electrical communication system, and a first environmental condition sensed by the sensor causes the lighting element to operate when the lighting system is disposed in a first operational orientation and a second environmental condition sensed by the sensor causes the lighting element to operate when the lighting system is disposed in a second operational orientation, the first environmental condition being different from the second environmental condition.

20 Claims, 8 Drawing Sheets

(56) References Cited

U.S. PATENT DOCUMENTS

| | | | | |
|---|---|---|---|---|
| 2016/0073477 | A1* | 3/2016 | Marman | G08B 13/19613 315/153 |
| 2016/0305619 | A1 | 10/2016 | Howe et al. | |
| 2016/0369991 | A1* | 12/2016 | Lim | F21V 23/0471 |
| 2016/0377275 | A1* | 12/2016 | Lim | G01J 5/0806 362/362 |
| 2017/0051926 | A1* | 2/2017 | Viswanathan | F24D 13/00 |
| 2017/0079117 | A1 | 3/2017 | Jayawardena et al. | |

* cited by examiner

LIGHTING APPLIANCE WITH MULTIPLE DETECTION MODES

CROSS-REFERENCE TO RELATED APPLICATIONS

This application claims the benefit of priority under 35 U.S.C. § 119 from U.S. Provisional Application No. 62/573,992, filed on Oct. 18, 2017, the disclosure of which is hereby incorporated by reference in its entirety for all purposes.

TECHNICAL FIELD

This disclosure relates to a lighting system having multiple operational modes and multiple mounting configurations.

BACKGROUND

Standard lighting systems are generally known in the art. Electronic lighting enables a wide range of indoor and nighttime activities. Electronic lighting is typically provided from devices mounted to fixed locations, where a light source receives electrical power from a wired power source or battery. Such lighting is useful in illuminating a specific area, but requires expensive professional installation. Because such electronic lighting devices must be hardwired and mounted to fixed locations, they cannot be easily relocated or adjusted after installation.

More recently, electronic lighting devices that can be installed by a consumer have been introduced. These electronic lighting devices include wires that are plugged directly into an electrical outlet. Such plug-in electronic lighting devices do not require drilling holes in a wall, running wires, or the addition of dedicated wall switches to activate the electronic lighting. Similar to hard-wired electronic lighting devices, plug-in electronic lighting devices are generally mounted to fixed locations. In addition, plug-in electronic lighting devices can only be mounted in locations where an electrical outlet is nearby.

However, such plug-in electronic devices do not have multiple operational or detection modes. The accessories or integrated features available on known lighting systems do not purposefully and effectively address these issues. The present disclosure seeks to overcome some limitations and other drawbacks of the prior art, and to provide new features not heretofore available.

Accordingly, there is an unmet need for an electronic lighting device that can be installed by a consumer, optimized to be mounted in a variety of locations away from an electrical outlet, and can be activated without the use of a dedicated wall switch. A full discussion of the features and advantages of the present disclosure is deferred to the following detailed description, which proceeds with reference to the accompanying drawings.

SUMMARY

In some implementations of the present disclosure, a lighting system is provided, including a housing, a lighting element at least partially disposed in the housing, an electrical communication system in communication with the lighting element, and a sensor disposed on a portion of the housing, the sensor being in communication with the lighting element via the electrical communication system, and a first environmental condition sensed by the sensor causes the lighting element to operate when the lighting system is disposed in a first operational orientation and a second environmental condition sensed by the sensor causes the lighting element to operate when the lighting system is disposed in a second operational orientation, the first environmental condition being different from the second environmental condition.

A lens attachment system can releasably connect a lens to the cover, and portions of the lens can be at least partially transparent. The lens attachment system can releasably and selectively connect more than one lens to the cover.

A base attachment system can releasably secure the base to another surface or item. The base attachment system includes one or more base attachment elements disposed on the base, and one or more surface attachment elements.

The battery can be a rechargeable-type battery and/or a replaceable-type battery.

A visual indication output by a charge indication light can indicate a particular charge degree, or charging status, of the battery. An audible indication output by a speaker can indicate a particular charge degree, or charging status, of the battery.

The first environmental condition can include a hand being proximate the sensor and being optically sensed by the sensor, and the second environmental condition can include a torso being proximate the sensor and being optically sensed by the sensor.

In some implementations of the present disclosure, a lighting system is provided, including a housing, a lighting element at least partially disposed in the housing, an electrical communication system in communication with the lighting element, and a sensor disposed on a portion of the housing, the sensor being in communication with the lighting element via the electrical communication system, and a change in a first environmental condition sensed by the sensor causes the lighting element to operate when the lighting system is disposed in a first operational orientation and a change in a second environmental condition sensed by the sensor causes the lighting element to operate when the lighting system is disposed in a second operational orientation, the first environmental condition being different from the second environmental condition.

A lens attachment system can releasably connect a lens to the cover, and portions of the lens can be at least partially transparent. The lens attachment system can releasably and selectively connect more than one lens to the cover.

A base attachment system can releasably secure the base to another surface or item. The base attachment system includes one or more base attachment elements disposed on the base, and one or more surface attachment elements.

The battery can be a rechargeable-type battery and/or a replaceable-type battery.

A visual indication output by a charge indication light can indicate a particular charge degree, or charging status, of the battery. An audible indication output by a speaker can indicate a particular charge degree, or charging status, of the battery.

The change in the first environmental condition can include a hand performing a gesture proximate the sensor, or moving so as to be proximate the sensor, and being optically sensed by the sensor, and the change in the second environmental condition can include a torso moving so as to be proximate the sensor and being optically sensed by the sensor.

BRIEF DESCRIPTION OF THE DRAWINGS

To understand the present disclosure, it will now be described by way of example, with reference to the accompanying drawings in which implementations of the disclosures are illustrated and, together with the descriptions below, serve to explain the principles of the disclosure. The present disclosure seeks to overcome some limitations and other drawbacks of the prior art, and to provide new features not heretofore available.

DETAILED DESCRIPTION

Figure 1:
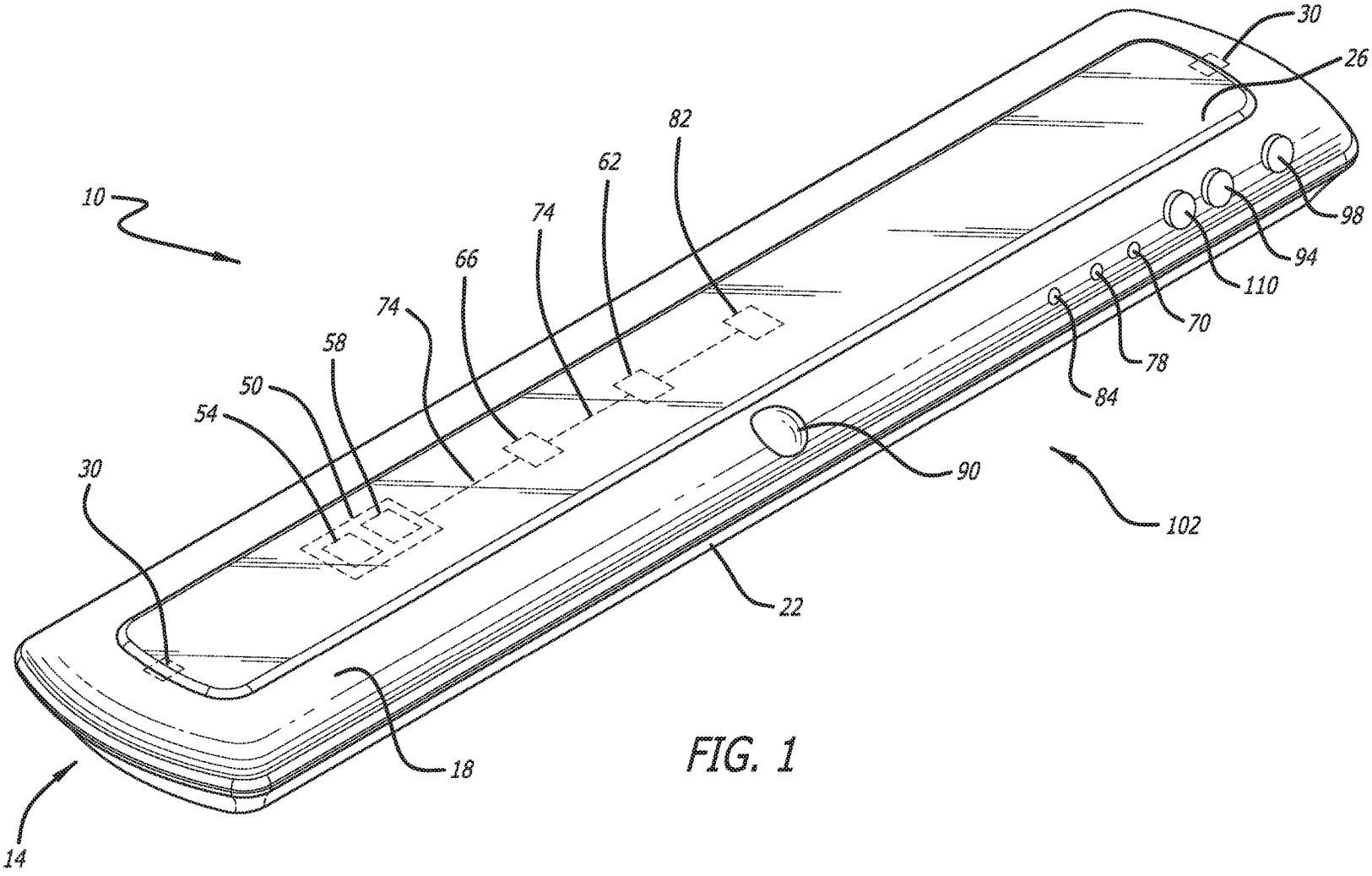
FIG. 1 is an upper perspective view of a first implementation of a lighting system according to exemplary implementations of the present disclosure, in particular showing the lighting system in a non-illuminating state.

While the lighting system discussed herein may be implemented in many different forms, the disclosure will show in the drawings, and will herein describe in detail, implementations with the understanding that the present description is to be considered as an exemplification of the principles of the lighting system and is not intended to limit the broad aspects of the disclosure to the implementations illustrated. Accordingly, the drawings and description are to be regarded as illustrative in nature and not restrictive.

Referring now to the figures, and initially to FIGS. 1-4, a lighting system 10 is disclosed. The lighting system 10, in some implementations, includes a housing 14 defined by a cover 18 and a base 22. A lens 26 is attached to the housing 14 and can further be attached to the cover 18. The lens 26 can also be releasably attached to the housing 14 and/or the base 22. The housing 14, cover 18, base 22 and/or lens 26 enclose various elements of the lighting system 10, which will be described below in further detail.

A lens attachment system 30 connects, or releasably connects, the lens 26 to the cover 18. At least portions of the lens 26 are transparent or partially transparent to allow light to pass therethrough. In some implementations, the lighting system 10 can include a plurality of different lenses 26 having different shapes, colors, opacities, textures, materials, patterns or other properties. Such a modular system having multiple lenses 26 enables a user to modify the lighting system 10 with different lenses 26 according to differing moods, lighting scenarios or power requirements. The different lenses 26 can be attached individually or in combination. The lens attachment system 30 can include interference fits, clips, snaps, buckles, hooks, adhesives, magnets, hook-and-loop panels, brackets, rotational locking fits or any other physical and/or chemical attachment system known to those skilled in the art.

Figures 3, 4:
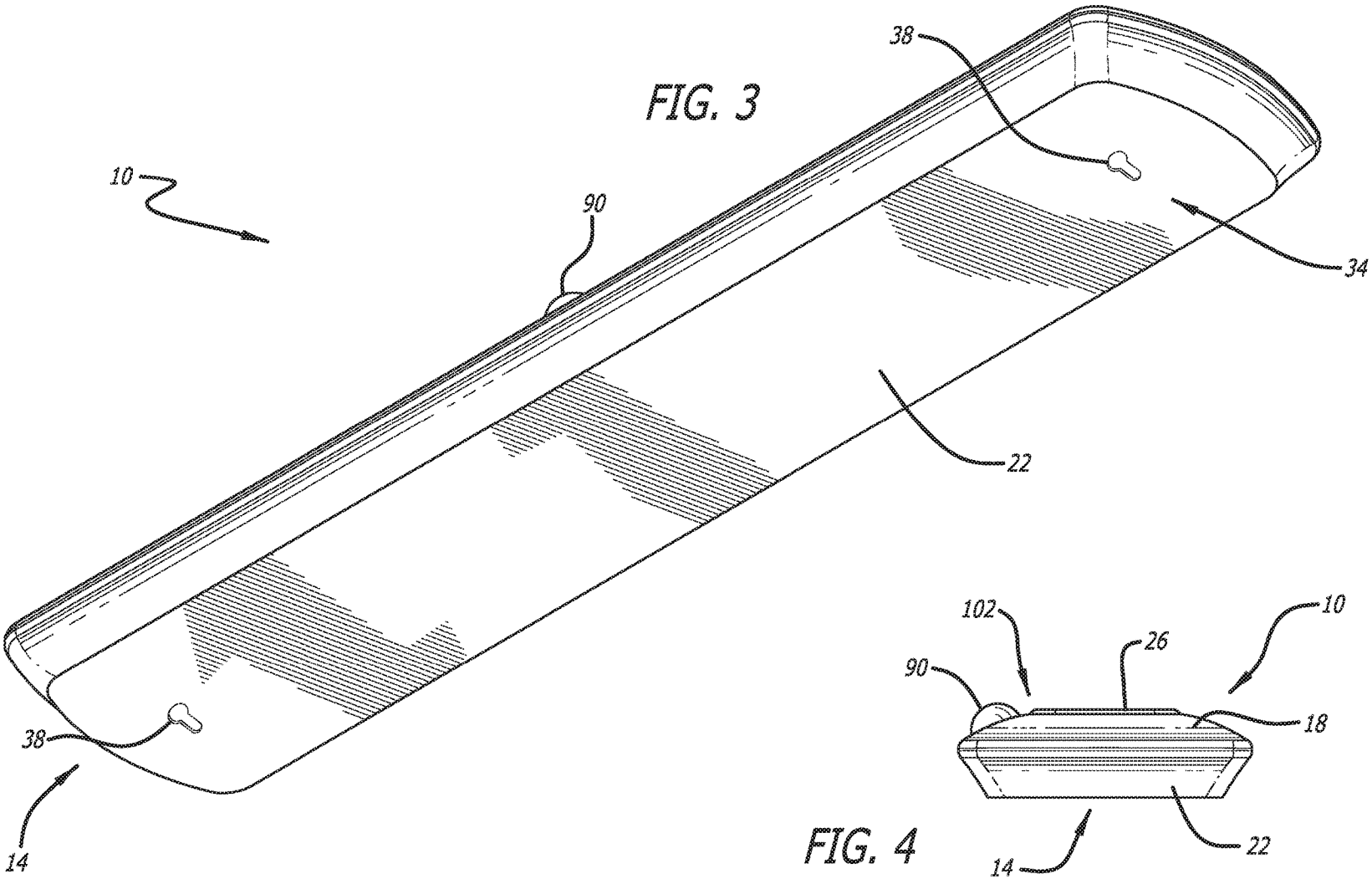
FIG. 3 is a lower perspective view of the lighting system of FIG. 1.
FIG. 4 is a side elevation view of the lighting system of FIG. 1.
Figure 5:
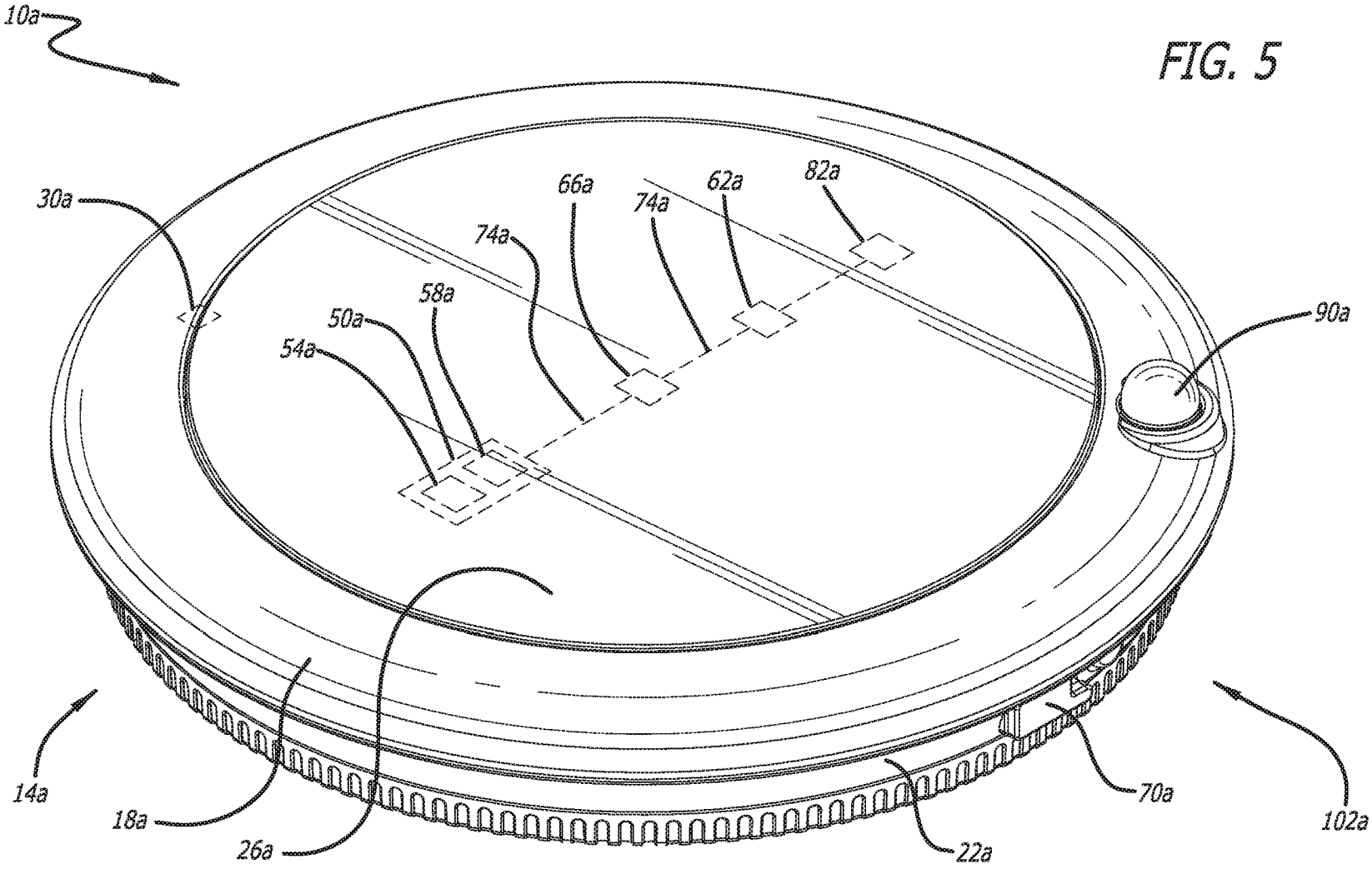
FIG. 5 is an upper perspective view of a second implementation of a lighting system according to exemplary implementations of the present disclosure, in particular showing the lighting system in a non-illuminating state.
Figure 6:
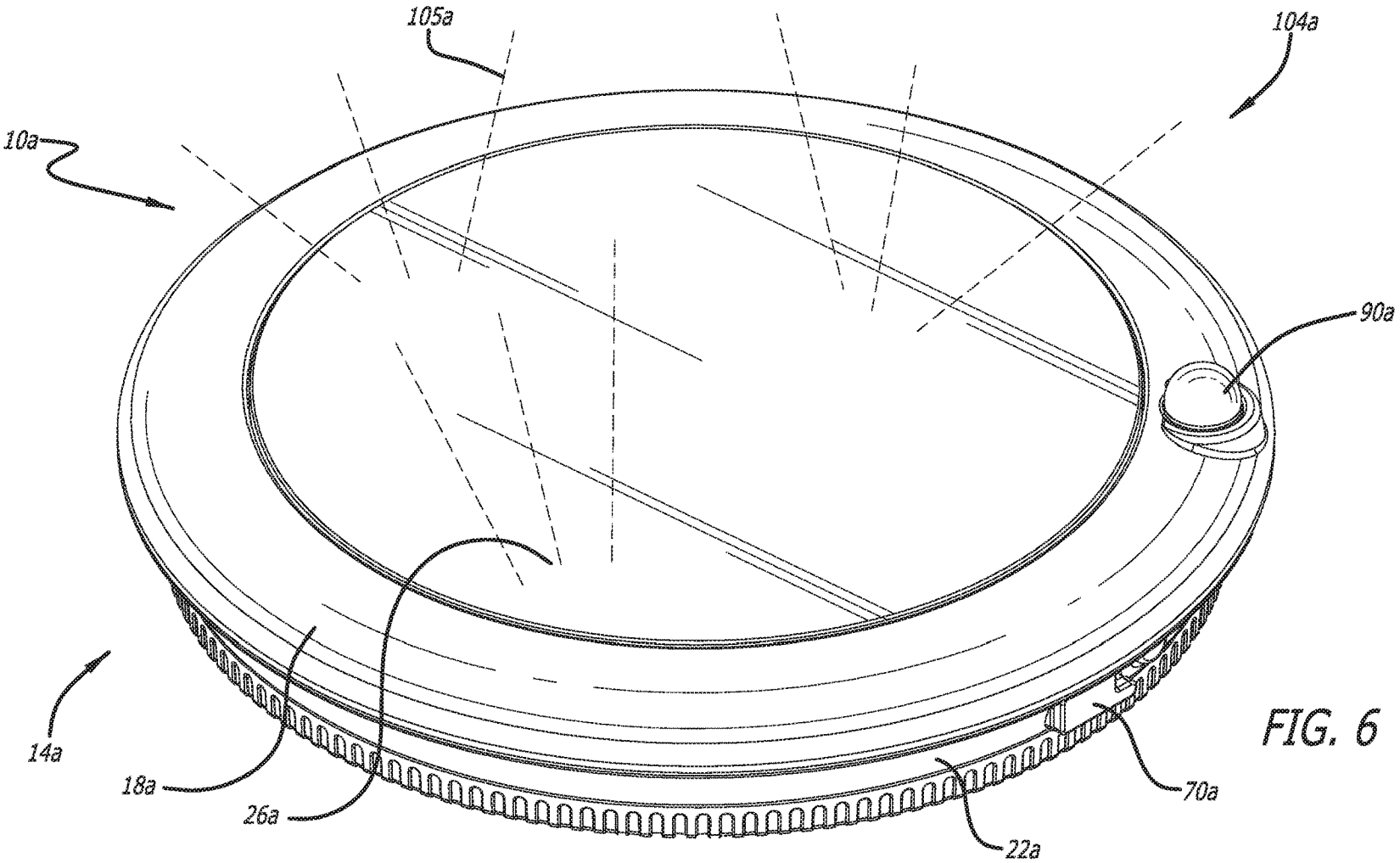
FIG. 6 illustrates the lighting system of FIG. 5, showing the lighting system in an illuminating state.
Figure 7:
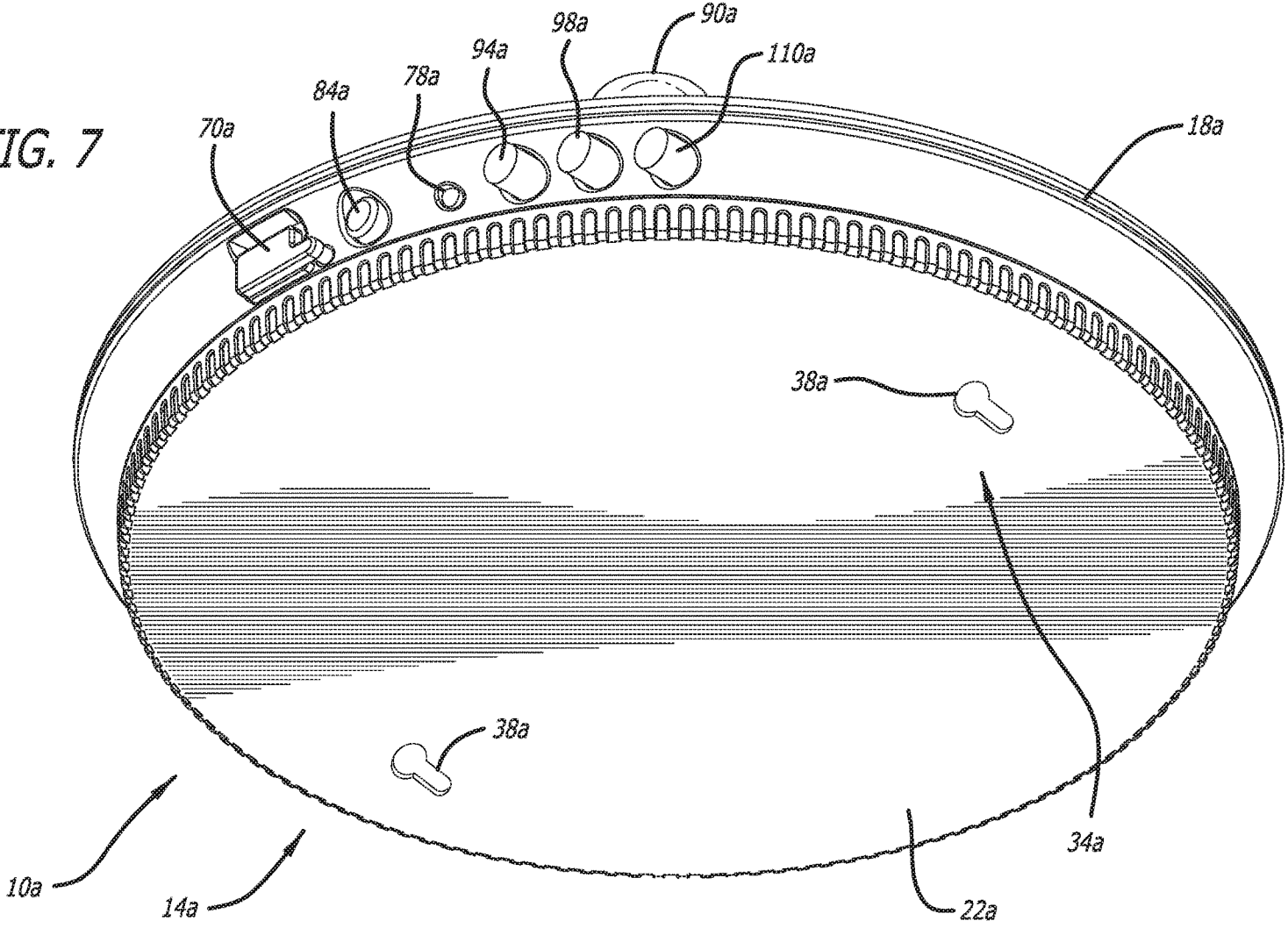
FIG. 7 is a lower perspective view of the lighting system of FIG. 5.
Figure 8:
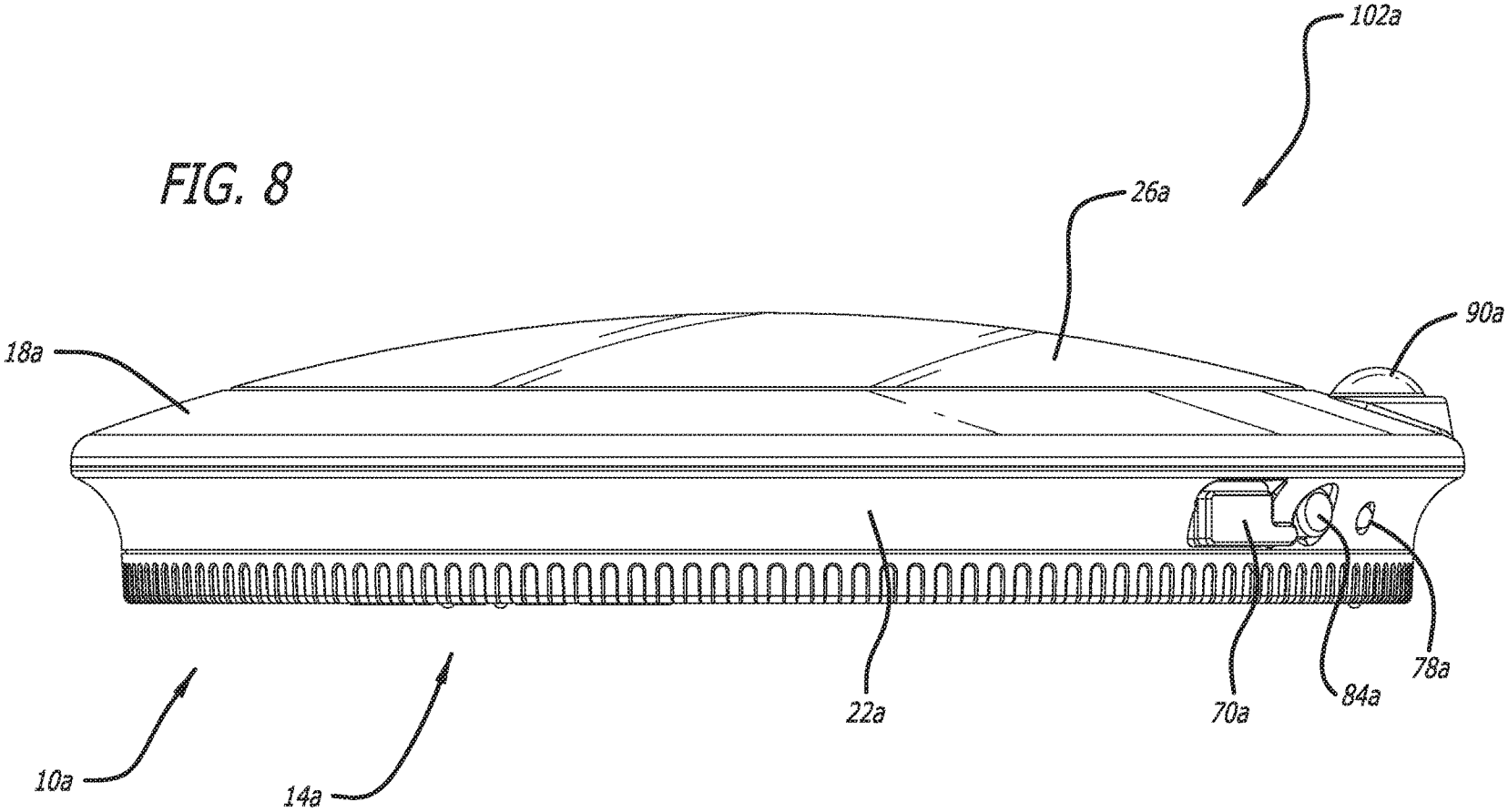
FIG. 8 is a side elevation view of the lighting system of FIG. 5.

Referring for example to FIG. 3, a base attachment system 34 can be attached to, or formed on, a portion of the base 22. The base attachment system 34 can secure, or releasably secure, the base 22 to another surface or item. In some implementations, the base attachment system 34 includes one or more base attachment elements 38, disposed on the base 22, as well as one or more surface attachment elements 42, disposed on a surface or object to which the base 22 is attached. These elements can be exemplarily seen in FIGS. 9 and 10. It is to be understood that the base attachment system 34 can, in some implementations, attach to a surface or object without the use of a surface attachment element 42. Similar to the lens attachment system 30, the base attachment system 34 can include interference fits, clips, snaps, buckles, hooks, adhesives, magnets, hook-and-loop panels, brackets, rotational locking fits or any other physical and/or chemical attachment system known to those skilled in the art. Further, the base attachment system 34 can attach the base 22, and thus the lighting system 10, to a surface or object in a plurality of orientations, as will be described below in further detail.

FIG. 1 illustrates exemplary interior lighting system 10 elements. In particular, some implementations of the lighting system 10 include an electronic communication system 48 including a circuit board 50, processor 54, memory 58, battery 62 and lighting element 66. The processor 54 and memory 58, along with other elements, can be disposed on the circuit board 50. The lighting system 10 can also include a power supply port 70, bus 74, charge indication light 78, speaker 82, microphone 84, sensor 90, brightness control 94 and a mode selector control 98. Each of these items will now be described in further detail.

Data received from the sensor 90, brightness control 94, power supply port 70, microphone 84 and/or mode selector control 98, which can be user manipulations, gestures, light levels, electrical current or sounds, among others, can be electronically communicated to the processor 54 and/or memory 58 via the electronic communication system 48. Based on this information, instructions stored in the memory 58 can command the processor 54 or other parts of the lighting system 10 to output commands to various elements of the lighting system 10, such as the lighting element 66, charge indication light 78 and speaker 82. These commands can be sent via the bus 74 or other electronic communication system 48 channels.

The battery 62 can be attached to any one or more of the lighting system 10, housing 14, cover 18, base 22 and lens 26, and can be a rechargeable-type and/or replaceable battery. The battery 62 can be in electrical communication with the power supply port 70, such that electrical energy entering the lighting system 10 via the power supply port 70 (for example from the grid, another battery, a photovoltaic solar array or a generator) can charge the battery 62 and/or power operations of the lighting system 10. The lighting element 66 can be any type of light-emitting device including, but not limited to, a Light-Emitting Diode, a fluorescent light bulb and an incandescent light bulb.

In some implementations, a visual indication is output by the charge indication light 78 indicating that the battery 62 is being charged or is charged to a particular degree, such as being substantially fully charged or substantially devoid of charge. In some implementations, an audible indication is output by the speaker 82 indicating that the battery 62 is being charged or is charged to a particular degree, such as being substantially fully charged or substantially devoid of charge.

Figure 2:
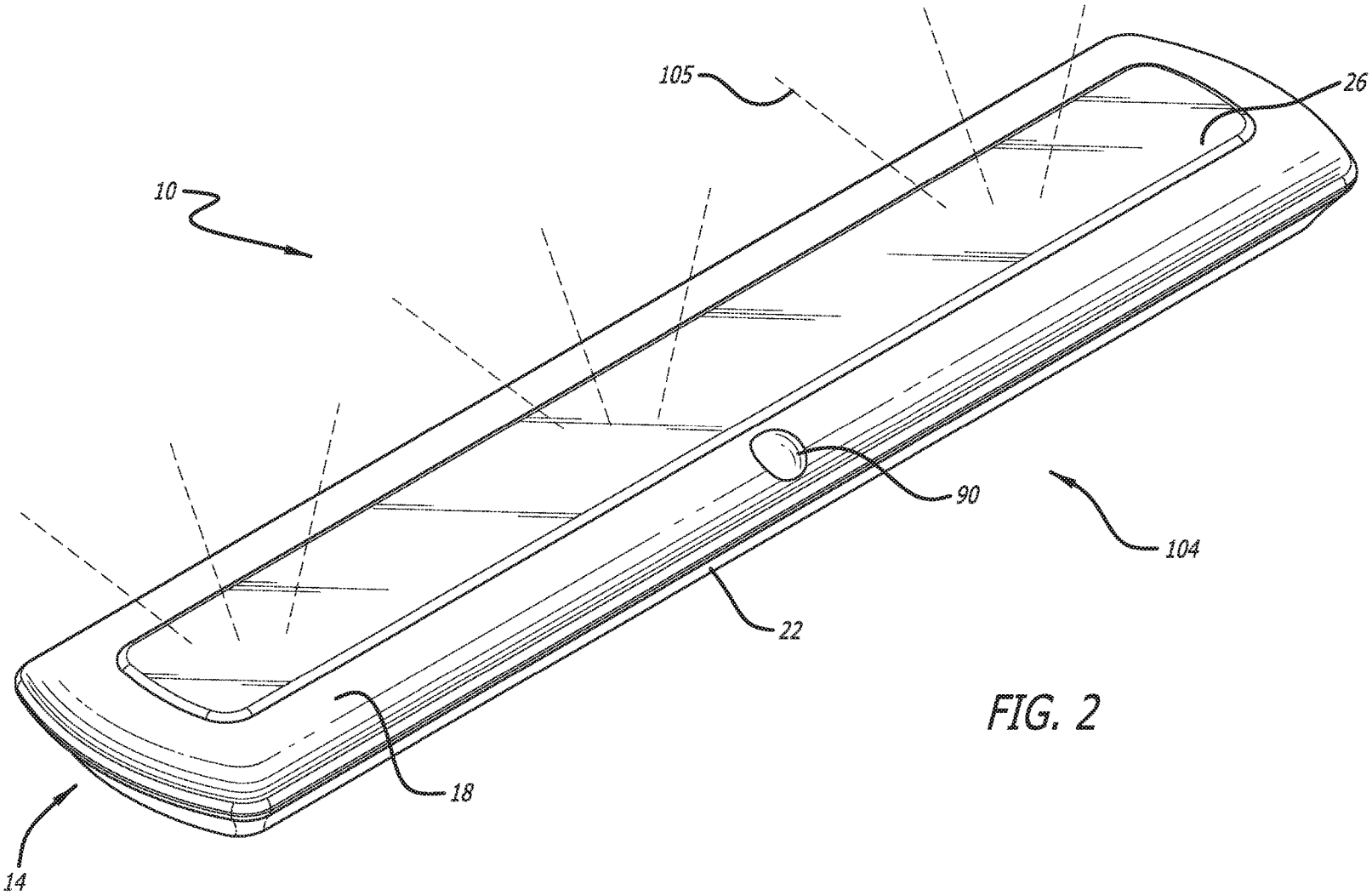
FIG. 2 illustrates the lighting system of FIG. 1, showing the lighting system in an illuminating state.

FIG. 1 illustrates the lighting system 10 in a non-illuminating state 102 and FIG. 2 illustrates the lighting system 10 in an illuminating state 104, as indicated by light rays 105. When the lighting system 10 is in the illuminating state 104, the lighting element 66 can output light through the lens 26 to an exterior of the lighting system 10. A user manipulation of the brightness control 94 can control a degree of lighting element 66 output while the lighting system 10 is in the illuminating state 104. Further, a user manipulation of a pattern control 110 can control a pattern of illumination output by the lighting element 66 while the lighting system 10 is in the illuminating state 104, such as a substantially solid light pattern or a 'flashing' light pattern where light is alternatingly output and not output by the lighting element 66 according to pre-set timing patterns.

The brightness control 94 and mode selector control 98 can each include dials, buttons, sliders or similar devices. The mode selector control 98 can control an operational mode of the lighting system 10. For example, the lighting system 10 can include a non-illuminating operational mode where the lighting system 10 is in the non-illuminating state 102, an illuminating operational mode where the lighting system 10 is in the illuminating state 104 and a selective operational mode where the lighting system 10 can selectively be in the non-illuminating state 102 or the illuminating state 104 depending on one or more of a variety of user inputs, lighting system 10 orientations, environmental conditions or other factors.

In some implementations, a user manipulates the mode selector control 98 to facilitate the lighting system 10 being in the non-illuminating operational mode, illuminating operational mode or the selective operational mode. In some implementations, the lighting system 10 operates solely in the selective operational mode and does not include a mode selector control 98. Exemplary selective operational mode features will now be described in detail.

In some implementations, the sensor 90 is a light sensor that senses a level of light in the environment around the lighting system 10. When the lighting system 10 is in the selective operational mode, light sensed below a threshold level of light by the sensor 90 causes elements of the lighting system 10 and/or electronic communication system 48 to command the lighting element 66 to operate. Such a lighting element 66 operation can be indefinite, until the level of light sensed by the sensor 90 rises above the threshold light level and/or for a period of time. Such a threshold level of light could correspond with a user placing a portion of his or her body, such as a hand, proximate the sensor 90.

In some implementations, the sensor 90 is a light or motion sensor that senses patterns of threshold levels of light in the environment around the lighting system 10. When the lighting system 10 is in the selective operational mode, a particular pattern of light below threshold levels sensed by the sensor 90 for particular periods of time causes elements of the lighting system 10 and/or electronic communication system 48 to command the lighting element 66 to operate. Such a lighting element 66 operation can be indefinite, until the particular pattern of threshold levels of light sensed by the sensor 90 ceases and/or for a period of time. Such a pattern of threshold levels of light could correspond with a user performing a particular gesture proximate the sensor 90, such as a hand motion.

In some implementations, when the lighting system 10 is in the selective operational mode, the sensor 90 can be an optical sensor that senses an environment around the lighting system 10. When a particular environmental condition, or changes between successive environmental conditions, is sensed, the sensor 90 causes elements of the lighting system 10 and/or electronic communication system 48 to command the lighting element 66 to operate. Such a lighting element 66 operation can be indefinite, until the particular environmental condition or changes between successive environmental conditions sensed by the sensor 90 ceases and/or for a period of time. The particular environmental conditions, or changes between successive environmental conditions, sensed could correspond with a user performing a particular gesture proximate the sensor 90. For example, the environmental condition could be a hand placed proximate the sensor 90, a body or body portion being placed proximate the sensor 90, changes in position or orientation of a hand placed proximate the sensor or changes in position or orientation of a body or body portion being placed proximate the sensor 90.

In some implementations, when the lighting system 10 is in the selective operational mode, the lighting system 10 can be disposed in a first mounting orientation 120 and a second mounting orientation 124. As can be seen in the figures, and in FIG. 4 in particular, the sensor 90 can be disposed towards one side of the cover 18, housing 14, base 22 and/or lighting system 10. Accordingly, when the lighting system 10 is disposed in the first mounting orientation 120, shown exemplarily in FIG. 9 as being mounted under a shelf, the sensor 90 can be disposed proximate, or angled towards, a user. When the lighting system 10 is disposed in the second mounting orientation 124, shown exemplarily in FIG. 10 as being mounted under a shelf, the sensor 90 can be disposed distal to, or angled away from, a user. Due to the differing proximities and/or angular relationships between the sensor 90 and user in the first and second mounting orientations 120, 124, a single type of user motion and/or position can be sensed differently by the sensor 90 when the lighting system 10 is disposed in the first mounting orientation 120 or the second mounting orientation 124.

Figure 9:
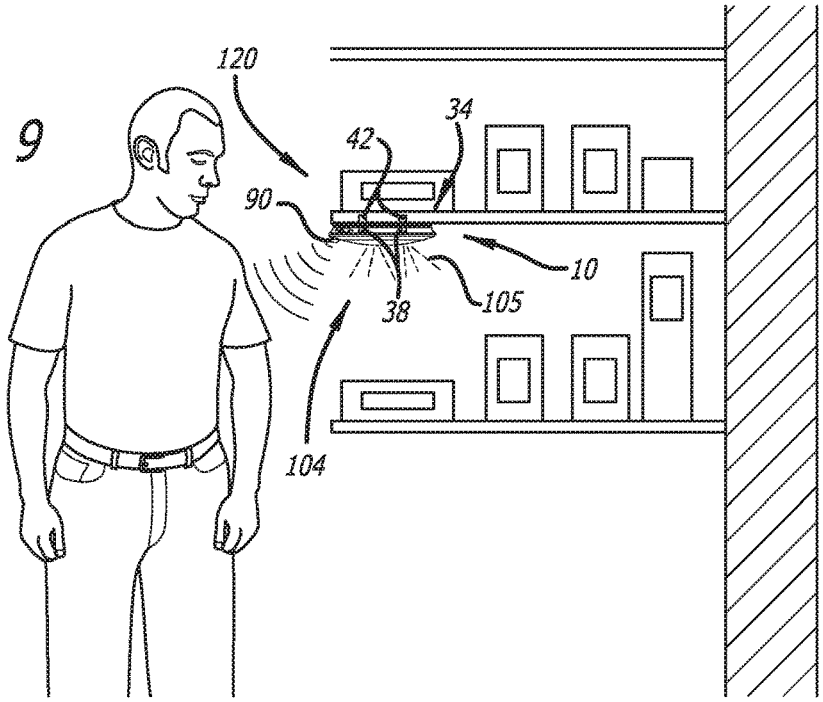
FIG. 9 illustrates an exemplary implementation of a lighting system disposed in a first state, and further illustrates a lighting element in the lighting system being activated when a first environmental condition, or a change in a first environmental condition, is sensed by the lighting system.
Figure 10:
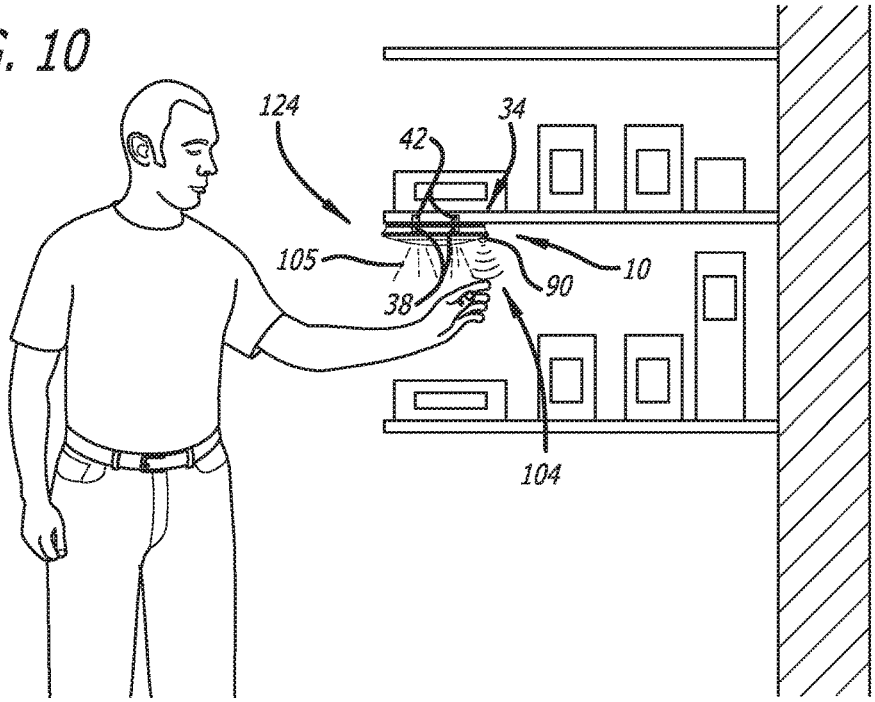
FIG. 10 illustrates another exemplary implementation of a lighting system disposed in a second state, and further illustrates a lighting element in the lighting system being activated when a second environmental condition, or a change in a second environmental condition, is sensed by the lighting system.

In some implementations, as shown in FIG. 9, a user being located proximate the lighting system 10, or moving to be proximate the lighting system 10, or performing a gesture proximate the lighting system 10, causes elements of the lighting system 10 and/or electronic communication system 48 to command the lighting element 66 to operate when the lighting system 10 is disposed in the first mounting orientation 120. In some implementations, as shown in FIG. 10, a user being located proximate the lighting system 10, or moving to be proximate the lighting system 10, or performing a gesture proximate the lighting system 10, does not cause elements of the lighting system 10 and/or electronic communication system 48 to command the lighting element 66 to operate when the lighting system 10 is disposed in second mounting orientation 124. Instead, as shown in FIG. 10, a user's hand being disposed proximate the lighting system 10, or moving to be proximate the lighting system 10, or performing a gesture proximate the lighting system 10, causes elements of the lighting system 10 and/or electronic communication system 48 to command the lighting element 66 to operate when the lighting system 10 is disposed in second mounting orientation 124. Thus, depending on the mounting orientation of the lighting system 10, differing functionalities are achievable by a single lighting system 10. The first and second mounting orientations 120, 124 can be achieved and facilitated by one or more of the base attachment elements 38 and surface attachment elements 42.

In some implementations, similar functionality can be achieved by rotating the sensor 90 relative to the remaining elements of the lighting system 10, such that the sensor 90 can be disposed in multiple orientations to achieve the above-described differing lighting system 10 functionalities. In some implementations, similar functionality can be achieved by obscuring portions of the sensor 90, or areas near the sensor 90, to achieve the above-described differing lighting system 10 functionalities.

In some implementations, when the lighting system 10 is in the selective operational mode, commands from a remote control (not shown) or a 'smart home' device cause elements of the lighting system 10 and/or electronic communication system 48 to command the lighting element 66 to operate. In some implementations, when the lighting system 10 is in the selective operational mode, acoustic commands from a user received by the microphone 84 cause elements of the lighting system 10 and/or electronic communication system 48 to command the lighting element 66 to operate.

It is to be understood that each of these operational modes, systems, selective-mode factors can operate in isolation or in conjunction with other described operational modes, systems and selective-mode factors.

FIGS. 5-8 illustrate a second implementation of the lighting system 10. As the functionality of this implementation of the lighting system 10 is similar to that described above, a duplicative description will be omitted. Elements in FIGS. 5-8 ending with the letter "a" have a similar design and functionality to the correspondingly-numbered element of FIGS. 1-4 not including the letter "a". Additionally, some implementations of the disclosed lighting system 10 can include elements, such as gaskets, rubber seals, grommets or other devices or materials designed to enable lighting system 10 operation in inclement weather, rain, extreme temperatures or other adverse conditions.

While some implementations have been illustrated and described, numerous modifications come to mind without significantly departing from the spirit of the disclosure, and the scope of protection is only limited by the scope of the accompanying claims.

The disclosed systems and methods are well adapted to attain the ends and advantages mentioned as well as those that are inherent therein. The particular implementations disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative implementations disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each article of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A lighting system, comprising:

a housing;

a lighting element at least partially disposed in the housing;

an electrical communication system in communication with the lighting element; and a sensor disposed on a portion of the housing, the sensor being in communication with the lighting element via the electrical communication system, and a first environmental condition sensed by the sensor causes the lighting element to operate when the lighting system is disposed in a first operational orientation and a second environmental condition sensed by the sensor causes the lighting element to operate when the lighting system is disposed in a second operational orientation, the first environmental condition being different from the second environmental condition and the first operational orientation being different from the second operational orientation, wherein the lighting element illuminates a first area when the lighting system is in the first operational orientation and a second area when the lighting system is in the second operational orientation, the first area being the same as the second area.

2. The lighting system of claim 1, wherein a lens attachment system releasably connects a lens to the a cover, and portions of the lens are at least partially transparent.

3. The lighting system of claim 2, wherein the lens attachment system releasably and selectively connects more than one lens to the cover.

4. The lighting system of claim 1, wherein a base attachment system releasably secures the base to another surface or item.

5. The lighting system of claim 4, wherein the base attachment system includes one or more base attachment elements disposed on the base, and one or more surface attachment elements.

6. The lighting system of claim 1, further comprising a battery, wherein the battery is a rechargeable-type battery.

7. The lighting system of claim 1, further comprising a battery, wherein the battery is a replaceable-type battery.

8. The lighting system of claim 1, further comprising a battery, wherein a visual indication output by a charge indication light indicates a particular charge degree, or charging status, of the battery.

9. The lighting system of claim 1, further comprising a battery, wherein an audible indication output by a speaker indicates a particular charge degree, or charging status, of the battery.

10. The lighting system of claim 1, wherein the first environmental condition includes a hand being proximate the sensor and being optically sensed by the sensor, and the second environmental condition includes a torso being proximate the sensor and being optically sensed by the sensor.

11. A lighting system, comprising:

a housing;

a lighting element at least partially disposed in the housing;

an electrical communication system in communication with the lighting element; and a sensor disposed on a portion of the housing, the sensor being in communication with the lighting element via the electrical communication system, and a change in a first environmental condition sensed by the sensor causes the lighting element to operate when the lighting system is disposed in a first operational orientation and a change in a second environmental condition sensed by the sensor causes the lighting element to operate when the lighting system is disposed in a second operational orientation, the first environmental condition being different from the second environmental condition and the first operational orientation being different from the second operational orientation, wherein the lighting element illuminates a first area when the lighting system is in the first operational orientation and a second area when the lighting system is in the second operational orientation, the first area being the same as the second area.

12. The lighting system of claim 11, wherein a lens attachment system releasably connects a lens to the a cover, and portions of the lens are at least partially transparent.

13. The lighting system of claim 12, wherein the lens attachment system releasably and selectively connects more than one lens to the cover.

14. The lighting system of claim 11, wherein a base attachment system releasably secures the base to another surface or item.

15. The lighting system of claim 14, wherein the base attachment system includes one or more base attachment elements disposed on the base, and one or more surface attachment elements.

16. The lighting system of claim 11, wherein the battery is a rechargeable-type battery.

17. The lighting system of claim 11, wherein the battery is a replaceable-type battery.

18. The lighting system of claim 11, wherein a visual indication output by a charge indication light indicates a particular charge degree, or charging status, of the battery.

19. The lighting system of claim 11, wherein an audible indication output by a speaker indicates a particular charge degree, or charging status, of the battery.

20. The lighting system of claim 11, wherein the change in the first environmental condition includes a hand performing a gesture proximate the sensor, or moving so as to be proximate the sensor, and being optically sensed by the sensor, and the change in the second environmental condition includes a torso moving so as to be proximate the sensor and being optically sensed by the sensor.

* * * * *